US005470192A

United States Patent [19]

Parri et al.

[11] Patent Number: 5,470,192

[45] Date of Patent: Nov. 28, 1995

[54] ARRANGEMENT FOR HANDLING CYLINDRICAL BODIES PROVIDED WITH CENTRAL HOLES

[75] Inventors: Mauri Parri, Vantaa; Markku Heino, Espoo, both of Finland

[73] Assignee: Nokia-Maillefer Holding S.A., Ecublens, Switzerland

[21] Appl. No.: 257,455

[22] Filed: Jun. 9, 1994

Related U.S. Application Data

[63] Continuation of Ser. No. 971,230, Nov. 4, 1992, abandoned.

[30] Foreign Application Priority Data

Nov. 27, 1991 [FI] Finland ..... 915580

[51] Int. Cl.[6] ..... B65G 63/00

[52] U.S. Cl. ..... 414/741; 414/751

[58] Field of Search ..... 414/751; 901/45, 901/49

[56] References Cited

U.S. PATENT DOCUMENTS

| | | | |
|---|---|---|---|
| 3,822,044 | 7/1974 | Riekkinen | 242/79 |
| 4,229,136 | 10/1980 | Panissidi | 901/16 X |
| 4,600,358 | 7/1986 | Graf | 901/16 X |
| 4,665,600 | 5/1987 | Faurie et al. | 901/29 |
| 4,726,725 | 2/1988 | Baker et al. | 414/910 X |
| 4,834,440 | 5/1989 | Kato | 414/917 X |
| 4,925,360 | 5/1990 | Kato | 901/49 X |
| 4,972,735 | 11/1990 | Torii et al. | 901/29 X |
| 5,017,075 | 5/1991 | Block | 294/119.1 X |

FOREIGN PATENT DOCUMENTS

| | | | |
|---|---|---|---|
| 0104589 | 5/1991 | Japan | 901/45 |
| WO82/02187 | 7/1982 | WIPO . | |

*Primary Examiner*—Donald W. Underwood
*Attorney, Agent, or Firm*—Nixon & Vanderhye

[57] ABSTRACT

An arrangement for handling cylindrical bodies provided with central holes, the apparatus comprising gripping arms provided with gripping pins, second means arranged to move the gripping arms to obtain a forward movement, third means arranged to wind the gripping arms clockwise and counterclockwise, and fourth means arranged to move the gripping arms towards each other such that the gripping pins are self-centeringly brought into alignment with the central holes of the cylindrical body and to make a reverse movement of release. To provide an arrangement operating with high speed, the second means by which the forward movement of the gripping arms is obtained and/or the third means by which the winding movement of the gripping arms is obtained are formed as an elastic structure in a predetermined area such that the gripping arms are capable of adapting, during the grip movement and movement of release, to the displacements of position within this area, the displacements being determined by the position of the body or the position of the stand carrying the body.

4 Claims, 2 Drawing Sheets

ARRANGEMENT FOR HANDLING CYLINDRICAL BODIES PROVIDED WITH CENTRAL HOLES

Figure 1:
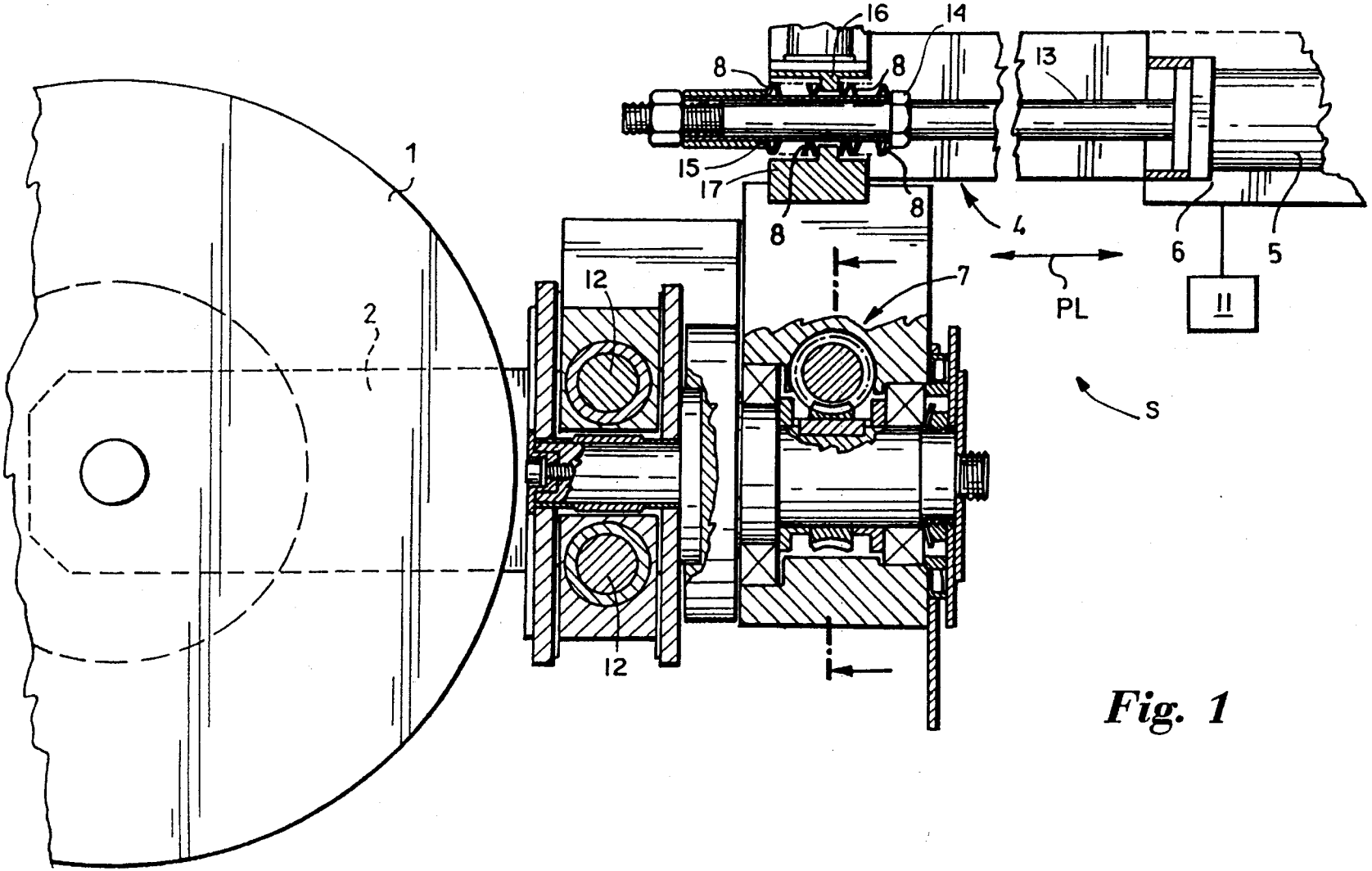

This is a continuation of application Ser. No. 07/971,230, filed Nov. 4, 1992, now abandoned.

The invention relates to an arrangement for handling cylindrical bodies provided with central holes, the apparatus comprising gripping arms provided with gripping pins, first means arranged to move the gripping arms in the horizontal and vertical direction, second means arranged to move the gripping arms to obtain a forward movement, third means arranged to wind the gripping arms clockwise and counterclockwise, and fourth means arranged to make a grip movement by moving the gripping arms towards each other such that the gripping pins are self-centeringly brought into alignment with the central holes of the cylindrical body and to make a reverse movement of release in which the gripping pins are disengaged from the central holes of the cylindrical body.

Today the above arrangements are known in various fields of technology. For example, arrangements of this kind are used in fields associated with cables, i.e. in the manufacture and use of cables, the users being the companies and communities manufacturing and using cables. Arrangements used in the handling of cable reels are described e.g. in U.S. Pat. No. 3,822,044, PCT Patent Application WO 82/02187 and Finnish Patent Application 842,988. Such arrangements are used, for example, for taking cable reels to reel positions in a storage of cables and, correspondingly, for fetching cable reels from reel positions. When a cable reel is fetched, the gripping arms of the arrangement are moved e.g. in a desired manner in the horizontal and/or vertical direction, a forward movement is made by moving the gripping arms forward to the cable reel in the reel position, and finally a grip movement is made by moving the gripping arms towards each other such that the gripping pins grip into the holes of the reel hub. Further, the gripping arms can be wound clockwise or counterclockwise, if necessary. When a cable reel is taken to a reel position, the principles of operation are the same but the steps are carried out in a reverse order.

The problem with the known solutions it to achieve sufficient accuracy. In practice it is rather difficult to bring the gripping pins sufficiently accurately into alignment with the holes of the reel hub in the gripping step and on the other hand it is difficult to achieve accurate release of the reel in the releasing step. These matters gain in significance if the measuring tolerances of the reel position and/or of the reel itself are high. On account of this, gripping arms are guided accurately in the horizontal and vertical directions etc. in the known solutions by using, in addition to the measured location data on the reel position, a separate location sensor and a counterpart of the sensor, e.g. a reflector, fastened to each reel position. However, displacements other than the above horizontal and vertical displacements, i.e. displacements in the direction of the forward movement and in the winding direction, remain problematic. To make the movements accurate, several correcting movements are needed, which in turn slows down the operation. Another drawback of the prior art is the high level of costs, for the tolerances required have been very low since the requirements for accuracy have been high.

The object of the invention is to provide an arrangement by means of which the drawbacks of the known art can be eliminated. This has been achieved by the arrangement of the invention, which is characterised in that the second means by which the forward movement of the gripping arms is obtained and/or the third means by which the winding movement of the gripping arms is obtained are formed as an elastic structure in a predetermined area such that the gripping arms are capable of adapting, during the grip movement and movement of release, to the displacements of position within this area, the displacements being determined by the position of the cylindrical body or the position of the stand carrying the cylindrical body.

An advantage of the arrangement according to the invention is above all that the gripping pins can be made to grip into the central holes of the cylindrical body without any time-consuming correcting movements. On account of the above the structure of the arrangement is simplified in regard to the previously known solutions and the costs decrease since the tolerances may be higher than before. Another advantage of the arrangement of the invention is the speed of operation, which is substantial particularly in connection with large storages of reels. A further advantage is the simplicity of the arrangement, whereby the production and servicing costs are not so high.

Figure 2:
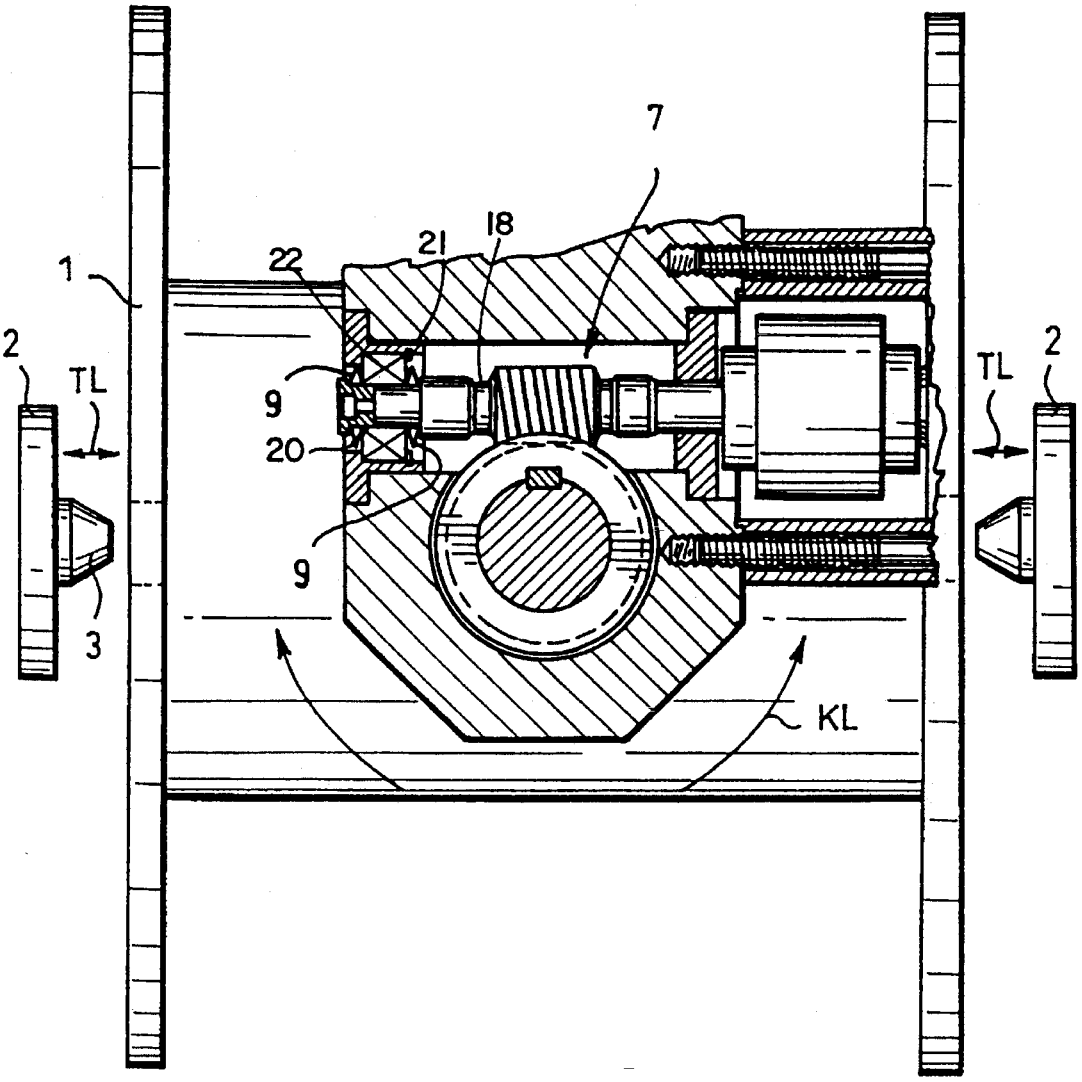

In the following the invention will be described by means of an advantageous embodiment presented in the drawing, wherein FIG. 1 shows a principle side view of an embodiment of the invention, and FIG. 2 shows a view of the embodiment of FIG. 1 in the direction of the arrows II—II.

FIGS. 1 and 2 show, in principle, an embodiment of the invention. The reference number 1 indicates a basically cylindrical body, such as a reel, which may be e.g. a cable reel. The number 2 indicates gripping arms in which are arranged gripping pins 3 for gripping the central hole of the reel 1. The arrangement comprises first means 11, which are arranged to move the gripping arms 2 in the horizontal and vertical direction. Such first means may be any solutions known per se, including e.g. rails, rollers, pillars and hydraulic cylinders.

Second means, which are arranged to move the gripping arms 2 to obtain a forward movement, are indicated generally in the figures by the number 4. The direction of the forward movement is indicated in FIG. 1 by the arrow PL. Here the forward movement means the movement of the gripping arms made e.g. after the first means have moved the gripping arms to a reel position, i.e. the movement by which the gripping arms are moved to a reel in a reel position in a gripping situation. Naturally, a corresponding movement is also made when a reel is released. The second means 4 may comprise a hydraulic cylinder 5 and a ball bushing 6.

Third means, which are arranged to wind the gripping arms 2 as a single whole clockwise or counterclockwise, are indicated generally in the figures by the number 7. The winding movement is indicated in FIG. 2 by the arrow KL. The third means 7 may comprise e.g. a spiral wheel structure.

The arrangement further comprises fourth means 12, which are arranged to make a grip movement by moving the gripping arms 2 towards each other such that the gripping pins 3 are self-centeringly brought into alignment with the central holes of the reel 1 and, in addition, a reverse movement of release in which the gripping pins 3 are disengaged from the holes of the reel 1. The grip movement and movement of release are indicated in FIG. 2 by the arrows TL. Such fourth means 12 may be any means known in the field, such as hydraulic cylinders, tooth wheels, tooth racks, or other corresponding means. The gripping pins 3 are preferably cone-shaped, whereby they operate self-centeringly.

The essential feature of the invention is that the second means 4 by which the forward movement of the gripping arms 2 is obtained and/or the third means 7 by which the winding movement of the gripping arms 2 is obtained are formed as an elastic structure in a predetermined area such that the gripping arms 2 are capable of adapting, during the grip movement and movement of release, to the displacements of position within this area, the displacements being determined by the position of the reel 1 or the position of the stand carrying the reel. By elasticity is meant that the structure comprising e.g. the gripping arms 2, i.e. the grab, is formed as a self-centering structure elastic within a certain area. By using a structure of spring members 8 in connection with the second means 4 by which the forward movement is obtained, a floating movement is obtained in a certain area, whereby the gripping arms 2 can be brought to a position according to the reel 1 in the direction of the forward movement in the gripping step. Particularly, the second means 4 includes shaft 13 and a pair of stops 14 and 15 on the shaft engaged by springs 8 located on opposite sides of a flange 16 located on a supporting member 17. In the reel release step, i.e. when a reel is brought to and left in a reel position, centering of the elastic area centers the reel 1 to a position desired but allows transfer in a certain area to a possibly unusual position determined by the stand carrying the reel, such as the reel cradle. On account of the above floating or adaptive structure, the position of the gripping arms need not be determined with absolute precision but the arrangement operates with higher location tolerances than before.

The operation of the above structure is clearly seen from FIG. 1, which shows that the piston rod of the hydraulic cylinder 5 is supported by the spring members 8 against the unit comprising the gripping arms 2, whereby the above floating structure is formed.

In connection with the third means by which the winding movement of the gripping arms is obtained a corresponding elastic structure can be provided by spring members 9. As shown in FIG. 2, the spiral wheel axle of the above third means 7 is supported, at one end thereof, by the spring members 9 against the unit carrying the gripping arms 2, whereby a floating structure is formed that is similar to that described above in connection with the second means 4 by which the forward movement is obtained. That is, third means 7 includes a shaft 18 mounting spring members 9 against stops 20 and 21 on said shaft 18 on opposite sides of a bearing 22. On account of the above structure, the arrangement according to the invention is also elastic in the winding direction KL, whereby the position need not be determined time-consumingly with absolute precision.

Any suitable spring members can be employed as the spring members 8, 9. For example, metal springs or other mechanical springs that are simple and do not require servicing can be used.

It will be appreciated that the second means 4, the third means 7 and the fourth means 12 are carried by a supped structure S carrying the gripping arms 2. Thus, the elastic structure, e.g., springs 8 and 9 forming part of the second means 4 and third means 7, respectively, is carried by the support structure S and cooperates therewith to compensate for misalignment of the gripping pins and the central openings and enable accurate alignment thereof whereby the gripping arms 2 are capable of adapting to deviations of relative position of the cylindrical body 1 and the gripping arms 2 from positions with the gripping pins 3 in accurate alignment with the central openings.

The above embodiment is not in any way intended to restrict the invention but the invention may be modified quite freely within the scope of the claims. Thus it is clear that the arrangement of the invention or the details thereof need not necessarily be exactly the same as shown in the figures but other kinds of solution are also possible. It is clear that e.g. the structure of the gripping arms need not be exactly the same as shown in the figures but that the gripping arms may also be different. In fact, the term in question should be understood to mean means in general for gripping a cylindrical body. Further, the manner of controlling the arrangement is not restricted in any way but the arrangement may be a part in a complex robot or a part in an apparatus moving along a simple rail. The spring members need not be metal springs but e.g. rubber springs or springs of plastic material can be used. The term spring member should be understood to describe the operation rather than the structure of the member. The only essential feature is that elasticity is not brought about by the operating pressure of e.g. the hydraulic cylinder 5 or some other corresponding hydraulic cylinder but by a member operating independently. In addition, the spring members need not necessarily be located at the exact positions shown in the figures but other positions are possible also, e.g. the attachment point of the hydraulic or pneumatic cylinder, the piston or some other part of the cylinder. Furthermore, the invention is not in any way restricted to be used only with cable reels but it can also be used in handling other corresponding cylindrical bodies provided with central holes.

We claim:

1. Apparatus for handling a cable reel having central openings on opposite sides thereof, comprising:

a support structure;

gripping arms carried by said support structure and having gripping pins configured for serf-centering with respect to the central openings upon engagement of the pins in the openings of the reel;

first means connected to said support structure for moving the gripping arms in horizontal and vertical directions;

second means carried by said first means for moving the gripping arms in a direction toward and away from the cable reel and including a linearly movable member and means for moving said linearly movable member in a linear direction;

third means carried by said linear movable member for movement with said linearly movable member and including a rotatable drive shaft mounting a drive gear, means for driving said drive gear and a rotatable second shaft having a driven gear in engagement with said drive gear and connected to said gripping arms for rotating said gripping arms in opposite rotary directions;

fourth means coupled to said second shaft for rotation therewith for moving the gripping arms toward each other such that said gripping pins are engageable in the central openings of the cable reel and for moving said gripping arms away from one another such that the gripping pins are disengaged from the central openings of the cable reel; and an elastic structure carried by said support structure and cooperable between at least one of said support structure and said second means on the one had and said second means and said third means on the other hand to compensate for misalignment of said gripping pins and the central openings of the cable reel and enable self-centering accurate alignment thereof, said elastic structure including a mechanical spring, one of said linearly movable member and said rotatable drive shaft having an axis end a stop, said spring being disposed about one of said member and said drive shaft and engaged with said stop for enabling said one of said member and said drive shaft for resiliently yielding movement in an axial direction in response to deviations of relative positions of the cable reel and the gripping arms from positions with the gripping pins in accurate alignment with the central openings.

2. Apparatus for handling a cable reel having central openings on opposite sides thereof comprising:

a support structure:

gripping arms carried by said support structure and having gripping pins configured for self-centering with respect to the central openings upon engagement of the pins in the openings of the reel;

first means connected to said support structure for moving the gripping arms in horizontal and vertical directions;

second means carried by said support structure for moving the gripping arms in a direction toward and away from the cable reel and including a linearly movable member and means for moving said linearly movable member in a linear direction;

third means carried by said linearly movable member for movement with said linearly movable member and including a rotatable drive shaft mounting a drive gear, means for driving said drive gear and a second shaft having a driven gear in engagement with said drive gear and connected to said gripping arms for rotating said gripping arms In response to driving engagement between said gears;

fourth means coupled to said second shaft for rotation therewith for:moving the gripping arms toward each other such that said gripping pins are engageable in the central openings of the cable reel and for moving said gripping arms away from one another such that the gripping pins are disengaged from the central openings of the cable reel;

an elastic structure carried by said support structure and cooperable between said linearly movable member and said third means to compensate for misalignment of said gripping pins and the central openings of the cable reel in a direction parallel to said linear direction and enable accurate alignment thereof whereby the gripping arms are capable of adapting to deviations of relative positions of the cable reel and the gripping arms in said parallel linear direction from positions with the gripping pins in accurate alignment with the central openings;

a stop carried by said linearly movable member;

said elastic structure being comprised of a spring engaging said third means and said stop enabling said third means for resiliently yielding movement in said linear direction in response to deviations of the cable reel and the gripping arms in said parallel linear direction from said positions with the gripping pins in accurate alignment with the central openings to compensate for misalignment thereof.

3. Apparatus for handling a cable reel having central openings on opposite sides thereof comprising:

a support structure;

gripping arms carried by said support structure and having gripping pins configured for self-centering with respect to the central openings upon engagement of the pins in the openings of the reel;

first means connected to said support structure for moving the 9ripping arms in horizontal and vertical directions;

second means carried by said first means for moving the gripping arms in a direction toward and away from the cable reel and including a linearly movable member and means for moving said linearly movable member in a linear direction;

third means carried by said linearly movable member for movement with said linearly movable member and including a rotatable drive shaft mounting a drive gear, means for driving said drive gear and a second shaft having a driven gear in engagement with said drive gear and connected to said gripping arms for rotating said gripping arms in response to driving engagement between said gears;

fourth means coupled to said second shaft for rotation therewith for moving the gripping arms toward each other such that said gripping pins are engageable in the central openings of the cable reel and for moving said gripping arms away from one another such that the gripping pins are disengaged from the central openings of the cable reel;

a stop carried by said third means;

an elastic structure carried by said third means and cooperable between said stop and said drive shaft to compensate for misalignment of said gripping pins and the central openings of the cable reel in a rotational direction about said second shaft and enable accurate alignment thereof whereby the gripping arms are capable of adapting to deviations of the relative positions of the cable reel and the gripping arms in said rotational direction from positions with the gripping pins in accurate alignment with the central openings;

said elastic structure being comprised of a spring engaging said drive shaft and said top enabling resiliently yielding movement of said drive shaft in response to deviations of the relative positions of the cable reel and the gripping arms in said rotational direction from said positions with the gripping pins in accurate alignment with the central openings.

4. Apparatus according to claim 2 including a stop carried by said third means, a second elastic structure carried by said third means and cooperable between said stop anti said drive shaft to compensate for misalignment of said gripping pins and the central openings of the cable reel in a rotational direction about said second shaft and enable accurate alignment thereof, said second elastic structure comprising a spring engaging said stop and said drive shaft enabling resiliently yielding movement of said drive shaft in response to deviations of the relative positions of the cable reel and the gripping arms in said rotational direction from said positions with the gripping pins in accurate alignment with the central openings.

* * * * *